United States Patent [19]

Callahan

[11] Patent Number: 4,460,943

[45] Date of Patent: Jul. 17, 1984

[54] AZIMUTH AND ELEVATION CONTROL SYSTEM

[76] Inventor: Michael Callahan, 201 W. 85th St., New York, N.Y. 10024

[21] Appl. No.: 443,128

[22] Filed: Nov. 19, 1982

[51] Int. Cl.[3] ..... F21V 17/02

[52] U.S. Cl. ..... 362/276; 362/96; 362/267; 362/268; 362/278; 362/285; 362/307; 362/319; 362/320; 362/321; 362/351; 362/451; 362/802

[58] Field of Search ..... 362/96, 267, 268, 276, 362/278, 285, 307, 319, 320, 321, 351, 451, 802

[56] References Cited

U.S. PATENT DOCUMENTS

| | | | |
|---|---|---|---|
| 1,680,685 | 8/1928 | King . | |
| 1,747,279 | 2/1930 | Andreino . | |
| 2,054,224 | 2/1936 | Levy | 240/61.1 |
| 2,950,382 | 8/1960 | Hatch | 240/3.1 |
| 3,209,136 | 9/1965 | Fisher | 240/3 |
| 3,845,351 | 10/1974 | Ballmoos et al. | 315/293 |
| 4,336,581 | 6/1982 | Morris | 362/457 |
| 4,338,655 | 7/1982 | Gulliksen et al. | 362/281 |

OTHER PUBLICATIONS

Izenour, "Automation in the Theatre", The Yale Scientific Magazine, May, 1955.

*Primary Examiner*—Stephen J. Lechert, Jr.
*Attorney, Agent, or Firm*—Kenyon & Kenyon

[57] ABSTRACT

A light projector suitable for performance lighting and provided with a means capable of adjusting beam azimuth and elevation from a remote location is provided with an input device locating the operator's finger, hand, or a stylus in two dimensions by non-mechanical means. The azimuth and elevation control means is capable of operation in either an incremental or rate of displacement mode.

18 Claims, 4 Drawing Figures

AZIMUTH AND ELEVATION CONTROL SYSTEM

BACKGROUND OF THE INVENTION

This invention relates to performance lighting and, more particularly, to a class of lighting fixture known as the followspot.

Followspots are light projectors designed for changes in beam azimuth, elevation, size, intensity, and generally shape and color, through the agency of a full-time operator, traditionally located next to the fixture and actuating its mechanisms directly by means of control levers projecting through the housing. A description of the Supertrouper followspot, for many years the standard of the industry, may be found in U.S. Pat. No. 2,950,382.

This ability to change beam parameters during a performance has made followspots an invaluable tool in lighting live presentations. Because of their ability to alter azimuth and elevation smoothly during a performance, followspots are uniquely capable of tracking or "following" a moving subject with a beam of light, providing a simple and efficient method of illuminating a performer moving onstage. This adaptability also allows followspots to cope with the unexpected; for example, when a performer stands where no conventional fixture has been aimed. The followspot's ability to alter beam size, shape and color further enhances its usefulness in these roles and allows a single followspot to produce a series of different lighting effects during a performance which might require dozens of conventional fixtures with their attendant support, cabling, dimming, and power requirements to duplicate.

The major drawback of current followspot designs is the requirement (unchanged since the beginning of the century) that the operator be positioned at the followspot, for it limits the latter to locations that will safely accommodate the former. It has long been apparent to those practicing in the art that considerable benefits would follow if the operator could be located remotely from the followspot itself. The followspot could be placed at the optimal location for lighting and the operator at the optimal location for his safety, efficiency, and comfort without requiring compromise for either. Permanent installations would be spared the cost of followspot booths and platforms; temporary users the present loss of seating and obstructed sightlines. Because it could be consistently located closer to the subject, remote followspots could also employ smaller and less expensive light sources.

Methods for remoting the azimuth, elevation, and beam size adjustment of performance lighting fixtures were first disclosed in the late 1920s in U.S. Pat. No. 1,680,685 and U.S. Pat. No. 1,747,279. Fixtures capable of tracking, and hence remote followspot use, are disclosed in U.S. Pat. No. 2,054,224 and U.S. Pat. No. 3,209,136. Fixtures incorporating such techniques have been prototyped, but in the 50 years since first disclosed, have made no commercial progress, despite the considerable and unique economic advantages that result from relocating the operator of an attended, variable parameter fixture at a location remote from the fixture. (These advantages are also far greater than those of adding both variable parameters and remote operation to conventional, unattended fixtures as was proposed by Izenour in the 1950s and disclosed by van Ballmoos in 1974.)

A major obstacle to the practical remote followspot has been the inability of the average operator to approach even his level of performance with an attended one.

A major problem has been that of resolution. At one moment in a performance, a followspot is called upon to sweep across a 60' stage in one continuous motion. A few minutes later, it may have to increment less than 2' to properly center an actor's head in a 12" diameter beam. Such a range of adjustments requires a resolution in excess of 360 parts. When applied to an attended fixture as disclosed in U.S. Pat. No. 2,950,382 with a housing over six feet in length, such resolution is possible in the hands of an experienced operator. When applied to a control lever, as disclosed in U.S. Pat. No. 2,054,224, where the handle moves through an arc of 4" per axis, a lever motion of approximately 0.01" is required for the 2" motion. An accidental lever motion of only 1/16' will cause the beam onstage to jump almost two feet. Such accidental motions are difficult to avoid when the beam must remain stationary for long periods, and even the simple expedient of "clutching out" on the control lever during such periods cannot be employed because of the errors it would introduce into the operator's estimation of azimuth and elevation and hence beam position.

It is the object of the present invention to provide methods of solving these difficulties with control for lighting fixtures with remote azimuth and elevation adjustment.

SUMMARY OF THE INVENTION

The present invention provides an azimuth and elevation control means which achieves these and additional objects through a number of unique features.

A major feature of the remotely controlled followspot of the present invention consists of a new type of input device and several related features which extend its usefulness.

The input device itself is one of a class which senses the location of the operator's finger, hand or a stylus or "mouse" on a surface by non-mechanical means. The advantages of the device in this application with a reduction in parts cost over a mechanical "joystick" as disclosed in U.S. Pat. No. 2,054,224 and the elimination of mechanical wear and failure.

Like all prior art remote units, the followspot of the present invention can use its input device in an absolute positioning mode; the position of the input device corresponding to a specific azimuth and elevation setting and hence, location onstage. However, the followspot of the present invention also provides incremental positioning, in which the input device is not connected with the beam directing means directly, but with a storage means holding a value for azimuth and another for elevation. These values, corresponding with the azimuth and elevation and hence location onstage, are incremented or decremented by the input device. Thus, the beam directing means is responsive to changes entered via the input device but not actual input device position. Therefore, the operator of the followspot of the present invention can remove his finger, hand, stylus or mouse from the sensing surface during long periods when no beam movement is required and subsequently return it to any location on the sensing surface without causing the beam to move. Instead, the beam will remain at the previous orientation/location until the operator begins to move his finger hand stylus or mouse, which will cause the beam to move in that direction by that proportional amount.

Additionally, the incremental function of the control system of the followspot of the present invention is provided with a "scaling" function. The operator may adjust the amount of azimuth and elevation movement for a given input device motion. Therefore, one transit of the sensing surface could drive the beam the full width of the stage, or one foot, depending upon the operator's selection as determined by his needs of the moment.

Such techniques as incremental control and scaling are not possible with prior art remote followspots because of the errors such techniques would produce in the operator's judgment of beam orientation/position. But with useful orientation/location data provided by other means described in a copending application, the followspot of the present invention does not require a correlation between input device position and that of the beam.

The followspot of the present invention also allows for rate of displacement control, which is particularly suited to subjects of substantially constant velocity, such as figure skaters.

The followspots of the present invention also provide additional features. The remotely controlled followspot of the present invention achieves a fluidity of motion generally limited to the experienced operator by means of electronic smoothing of azimuth and elevation motions.

In addition, a method of adjusting beam size of unusual simplicity and optical efficiency, particularly suited to remote control, is disclosed.

DETAILED DESCRIPTION

Figure 1:
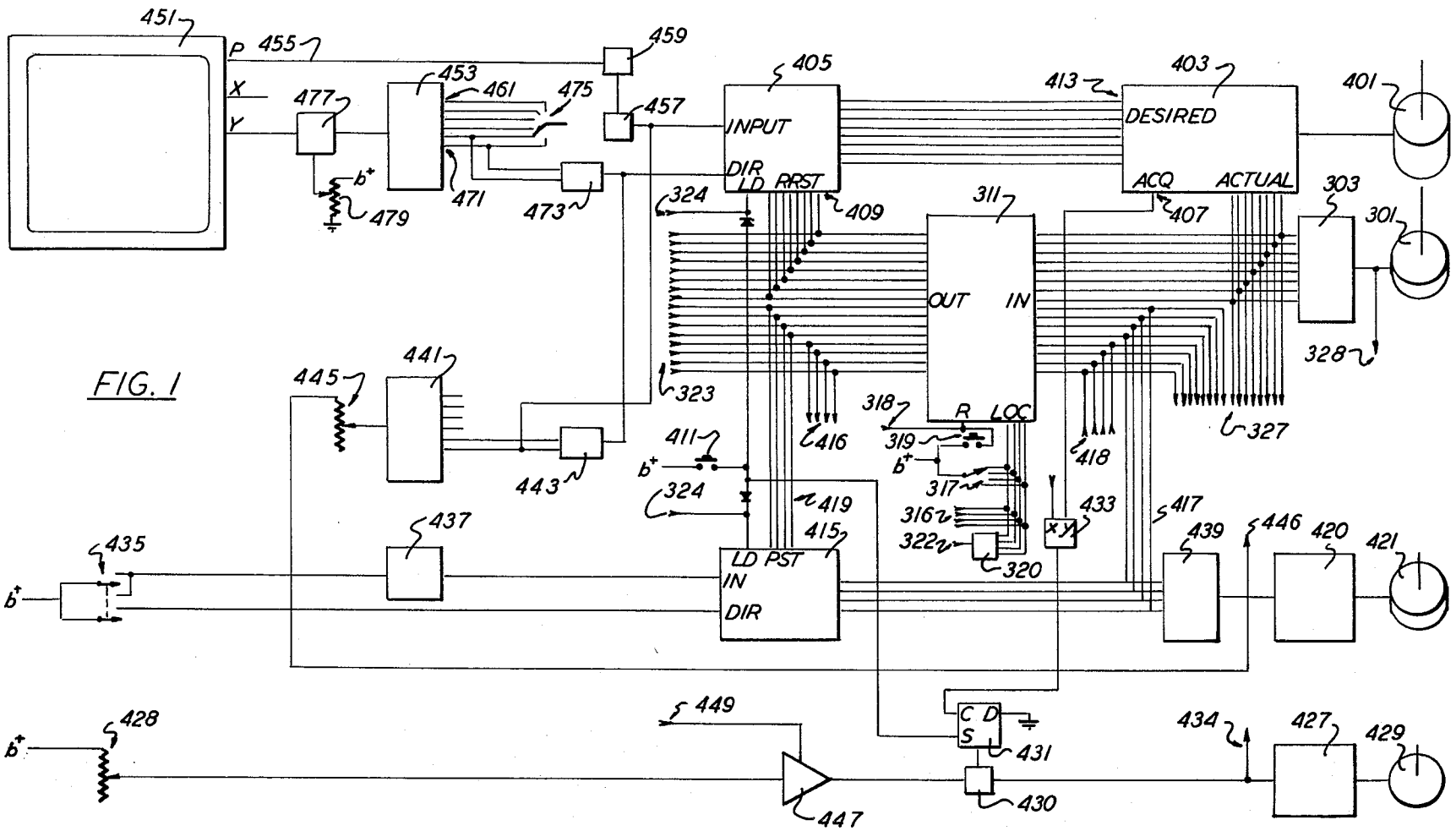
FIG. 1 is a block diagram of an incremental control system of the remote followspot of the present invention.

FIG. 1 illustrates features of the remote followspot of the present invention, including a non-mechanical input device and an incremental control system. For reasons of clarity, only the electronics for the elevation control system is shown, that for azimuth control being identical.

Figures 3, 3A:
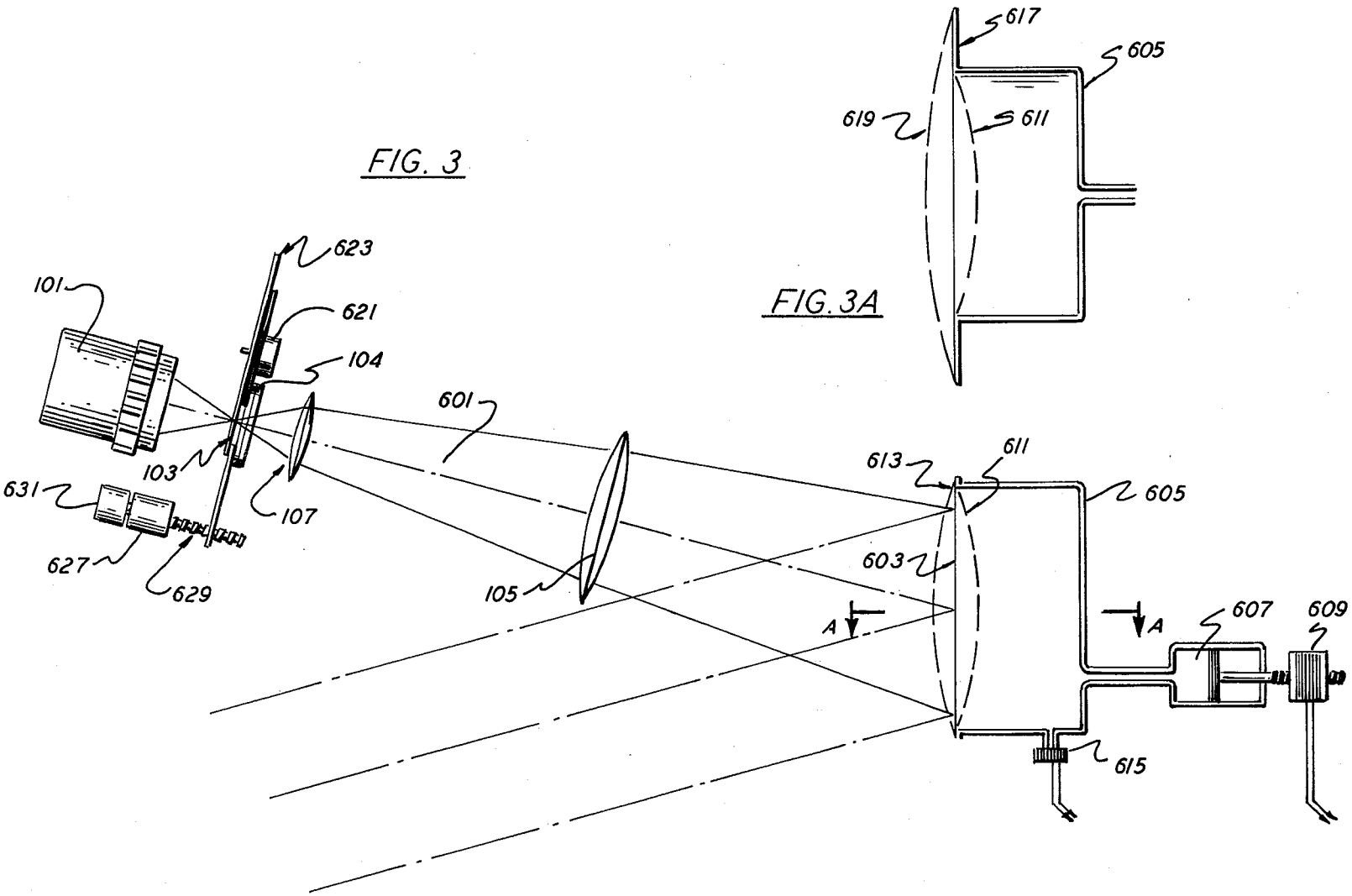
FIG. 3 is a sectional view of an improved beam size system of the followspots of the present invention.
FIG. 3A is a section A—A through FIG. 3.

FIG. 1 illustrates how a position locating system as described in FIG. 3 of the copending application Ser. No. 443,127 filed on even date herewith can, by being linked to a motor drive system responsive to feedback, navigate the followspot to the desired "pickup" orientation/location without operator intervention.

The followspot of the present invention illustrated in FIG. 1 is provided with a beam directing motor 401 provided, in turn, with a drive unit 403 suited to the motor design and load characteristics. The motor drive accepts a digital word from a counter 405 corresponding to the desired orientation which is compared with the actual orientation as sensed by transducer 301 and digitized by A/D converter 303. A common feature of drives of this type is an "Acquire" output 407 provided when both actual and desired position figures agree.

The counter 405 contains a value corresponding to the desired orientation (and hence location onstage) as entered by the operator using methods described below. Location data may be stored in a memory unit 311 during rehearsal by selecting a storage location with switch 317 and pressing a "record" button 319, causing the memory device to enter the current output of the A/D converter 303.

The automatic pickup system of the followspot of the present invention uses a commonly-available counter type known as a "presetting" unit, which is capable of replacing the value currently held with another present at its "preset" input 409. To return to a given location onstage, the operator simply presses a "go to" button 411 causing the digital word that represents the desired orientation/location preselected by the operator via switch 317 to be loaded into counter 405. This value appears at the motor drive's desired position input 413, and the drive conforms the beam directing means to that orientation/location.

The remotely controlled followspot of the present invention uses one of a class of devices sensing the location of an operator's finger, hand, stylus or a mouse on a surface in two axes. Many suitable devices are available and the choice of device and manner in which data is transmitted and utilized does not bear on the principles of the present invention. Devices are available that sense finger, hand, stylus or mouse position by resistive or capacitive means; through the closure of a matrix of fine wires embedded in or conductive traces deposited on a membrane; by obstruction of light beams parallel to the surface; and by ultrasonic ranging across it. Such devices may produce pulse trains or analog or digital values depending upon their operating principles and the type and amount of processing circuitry incorporated in the device.

Figure 2:
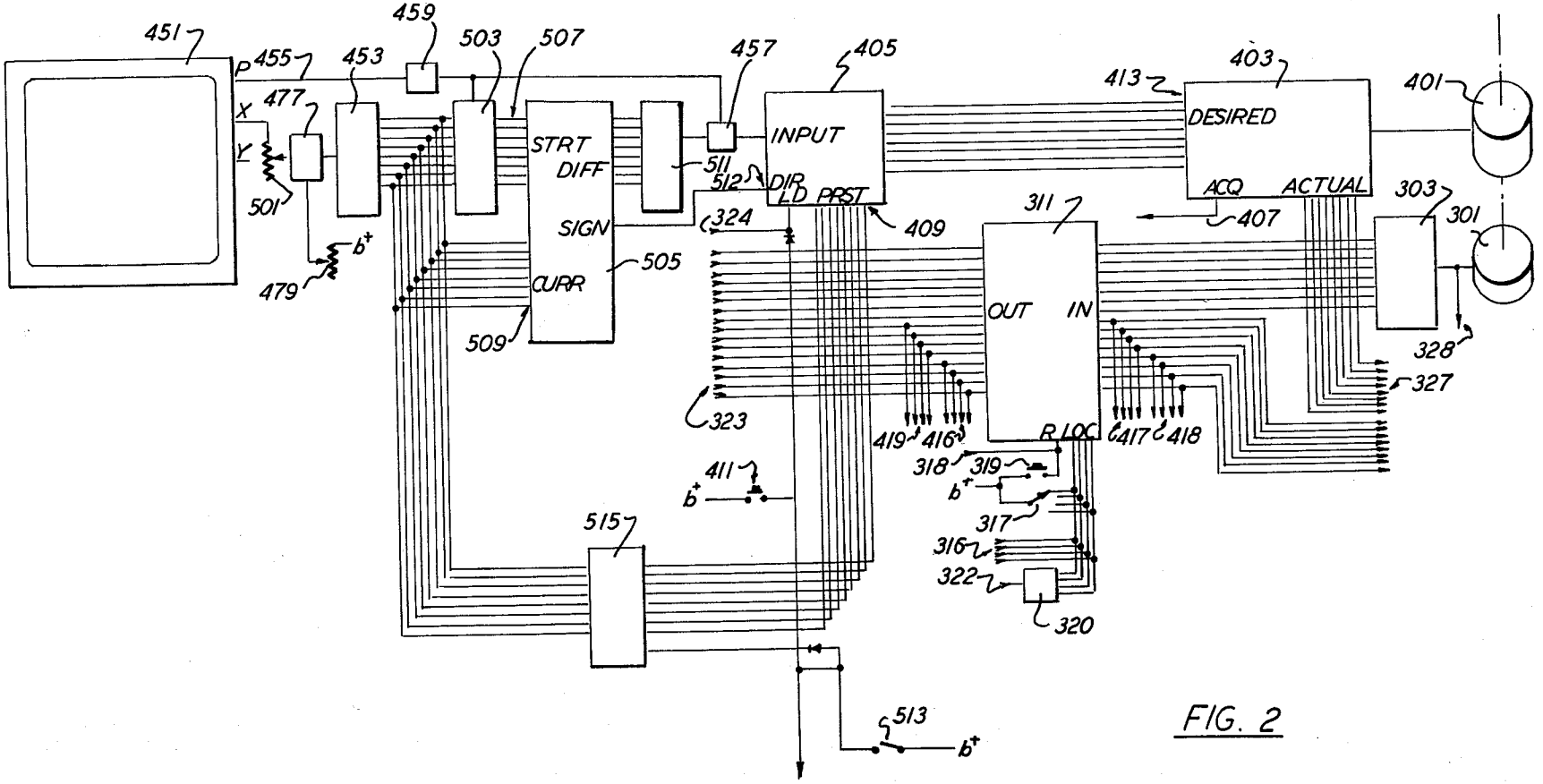
FIG. 2 is a block diagram of a rate-of-displacement control system of the remote followspot of the present invention.

The embodiments illustrated in FIGS. 1 and 2 show a non-mechanical input device 451 manufactured by Peptek, Inc., 9839 Singleton Drive, Bethesda, Md. which produces analog values corresponding to the location of the operator's finger in the X and Y axes of the sensing surface. An additional "presence" signal on line 455 is generated when the operator's finger is in contact with the sensing surface.

The control system in FIG. 1 feeds the analog output for a given axis of input device 451 to an A/D converter 453 which is used to feed bidirectional counter 405. The sum held by counter 405 represents the desired orientation/location for that axis and the motor drive 403 conforms the beam directing means to that orientation/location as was described above.

When the operator sets his finger on the touchpad of device 451 the leading edge of the presence signal on line 455 closes a switch or gate 457 after a brief delay provided by a delay device 459, e.g., a monostable multivibrator, to allow the A/D converter 453 to stabilize.

As the operator moves his finger across the touchpad surface, the analog value for the axis changes, and with it, the output of the A/D converter 453. The state changes on the A/D converter's outputs 461–471 serve as a source of square-wave pulse trains. The number of pulses on a given output is directly proportional to the distance the operator's finger moves on the touchpad 451.

A quadrature detector 473 uses the sequence of state changes of the A/D converter's two least significant bits on lines 469 and 471 to determine the direction of finger travel, and causes the counter 405 to change its value up or down accordingly.

When the operator removes his finger from the sensing surface the falling edge of the presence signal on line 455 opens the gate 457 (the delay circuit being inoperative on the falling edge) and no further pulses reach the counter, freezing the beam at its most recent orientation/location. When the operator replaces his finger on the touchpad again, no incrementing pulses reach the counter due to gate 457. When the operator begins to move his finger again, the A/D converter 453 and the quadrature detector 473 operate as described and the pulses produced change the most recent value/orientation/location.

Although, the non-mechanical input device of the control system of the present invention is clearly preferable; a conventional, mechanical joystick, trackball, or "mouse" could be employed with the addition of an "engage" switch, actuated by the operator, which produces the "presence" signal.

The remote followspot of the present invention provides for a "scaling" feature which, as previously described, varies the response in beam motion to a given input value change. Many methods of accomplishing this object are possible. The system in FIG. 1 makes use of the fact that pure binary progressions will produce a number of pulse trains at the A/D converter's outputs 461–471 which, for a given finger travel, will differ in pulse count by factors of two. By connecting the input of the counter 405 to different A/D outputs by means of switch 475 the scale factor of the system can be adjusted accordingly. Scaling can be accomplished in analog stages by attenuation. Amplifiers with adjustable gain are another method. Pulse trains which employ frequency shifting by methods including multiplication or division by hardware or software.

FIG. 1 also shows a means of smoothing azimuth and elevation adjustments electronically to provide the actions of even an inexperienced operator of the remote followspot of the present invention scaled for high system gain, with a fluidity of motion formerly limited to experienced operators of large attended followspots (such as the Supertrouper unit mentioned above) having good inertial characteristics. A simple RC delay circuit 477 is inserted into the analog stage of the system which provides adjustment of the slew rate via potentiometer control 479. Many other techniques of ramping system response are possible in both hardware and software at analog, pulse or digital levels.

FIG. 2 shows a rate of displacement control system for the remotely controlled followspot of the present invention. Parts with the same function as in FIG. 1 use the same reference numbers.

Rate of displacement is a control technique not previously used in the performance lighting field. It represents another approach to solving the resolution problems that attend the absolute positioning mode used by prior art units. Because of the nature of its response, rate of displacement systems are particularly well-suited to tracking performers whose direction changes but whose velocity remains substantially constant such as figure skaters.

As with the incremental control system illustrated in FIG. 1, the beam directing means for each axis is provided with an actuator drive 403, response to the desired position value produced by a counter 405. Like the system disclosed in FIG. 1, an automatic pickup system is provided by means of a memory device 311 loading the presettable counter's input. A storage position selector 317, "record" button 319, "go to" button 411, and interface to external devices 323 are provided. Present position data is produced by a transducer 301 via a A/D converter 303 and is provided to the motor drive 403, memory device 311 and outboard interface 327. The "load" or preset input to the counter is also made available for external access via line 324.

Like absolute and incremental systems, a rate-of-displacement system could employ a mechanical input device, such as a center-return two-axis joystick which produces analog values corresponding to the distance from center the control lever is moved (or the amount of pressure applied to the handle, in the non-displacement version). Such an input device may be connected to a pulse generator/quadrature detector combination which increments or decrements the counter 405 in a manner similar to the embodiment illustrated in FIG. 1. However, because mechanical joysticks are subject to wear and failure problems, a non-mechanical input device is preferred. Accordingly, a means of generating rate of displacement information from such a device is required and FIG. 2 illustrates one such means.

Furthermore, because no single input mode will prove ideal for all tasks and all operators, the present invention provides the operator with a choice of several input modes. FIG. 2 illustrates a system capable of both rate of displacement and absolute mode operation. To simplify illustration, the incremental system has been presented separately, but it will be apparent by the number of common components that a single system can be built which provides all three. Furthermore, although the systems illustrated here are hardware devices, it is clear that when manufacturing volume permits, many of the functions could be accomplished by a microprocessor. Finally, although the systems illustrated in FIGS. 1 and 2 show neither present position nor steering displays for reasons of clarity, such displays can be readily provided.

FIG. 2 shows the input device 451 with its associated scaling control 501, damping circuit 477, its associated adjustment control 479, and A/D converter 453. When the operator places his finger on the input device at any point, the leading edge of the presence signal on line 455 after a brief delay provided by delay device 459 causes latch 503 to store the digitized location of the operator's finger on that axis and causes gate 457 to close.

While the operator's finger remains at the starting point, both inputs to a subtraction unit 505 which follows latch 503 remain equal. Therefore, the unit's output is zero. However, once the operator moves his finger away from the starting point, the subtraction unit 505 will calculate the difference between the current position as received at input 509 and the starting position as received at input 507 from latch 503. That difference, expressed as an absolute number, determines the pulse rate of a digitally controlled pulse generator 511 which drives the bidirectional counter 405, the sign of the difference via input line 512 determining whether the counter counts up or down.

The rate at which the beam moves in a given direction is, thus, determined by the distance the operator's finger has moved from the starting point. Moving his finger away from that point increases the rate of travel; keeping it fixed at a location other than the starting point produces a constant speed determined by the distance from start, and moving his finger closer to the starting point will decrease rate of travel. Should the operator remove his finger from the input device at any time, the presence signal ceases and its trailing edge causes the gate 457 between the pulse generator 511 and the counter 405 to open, and the beam's motion stops.

When the operator returns his finger to the sensing surface, no matter what the location, the leading edge of the presence signal on line 455 causes the latch 503 and subtractor 505 to define that location as the new starting point.

The system illustrated in FIG. 2 is also capable of absolute positioning operation. Closing mode switch 513 closes a switch 515, connecting the output of A/D converter 453 to the presetting input 409 of counter 405, while switch 513 also holds the counter's "load" input high. This causes the current value produced by A/D converter 453 to be visible to motor drive 403, which conforms the beam to that position.

It will be understood that the specific systems illustrated in FIGS. 1 and 2 for azimuth and elevation control represent only one of many methods of achieving the objects of incremental and rate of displacement control. It will be understood that while the beam directing means motor drive 403 is illustrated as a closed-loop system accepting a digital input, that many other approaches to system design including analog and open-loop operation are possible.

Because remote followspots have never been practical enough for production, there has been virtually no field experience with them, and as a result the mechanical and optical design of such units is still largely hypothetical. Attention has been focused almost exclusively on methods of azimuth and elevation adjustment to the detriment of other aspects of remote fixture design. Instead, it has been assumed that remote fixtures will simply employ the same optics and beam size and color adjustment mechanisms as prior art attended units, with the addition of actuators to the control handles. However, for the reasons explained below, such mechanisms do not represent the optimal solution to the requirements of remote operation. The scope of the present invention, thus, includes an improved means of beam size adjustment particularly suited to remote operation.

In order to produce the beam diameters required for the lighting effects demanded of followspots and do so over the range of "throws" or fixture-to-subject distances encountered, followspots require a range of beam diameter adjustment greater than any other single fixture used in performance lighting. Prior art followspots for professional use generally produce a 9:1 or greater beam size range with a combination of two techniques: variable diameter aperture and variable focal length optics.

Followspots image a circular gate/aperture. Reducing gate/aperture diameter with an iris reduces beam diameter accordingly. This method is both simple and inexpensive. However, it has two major disadvantages. One is that the range of adjustment is generally limited by deterioration in the followspot optics' performance at very small apertures. The second disadvantage is that because a followspot's optics are optimized for the full aperture, the unused portion of source output is generally wasted when the aperture size is reduced. This makes variable-aperture alone particularly ill-suited as a means of compensating for longer "throws."

The other approach to beam size control is variable focal length optics. Television and motion-picture camera lenses with ranges as high as 30:1 have been built. However, such lenses require a number of lens elements of a sophistication moving in complex relationships far beyond practical application to performance lighting. As a result, varifocal lens systems employed in prior art followspots have generally used only two lens elements with consequent limitations on ratio. As a result, most prior art followspots for professional use employ a combination of both variable aperture and variable focal length.

The task of designing such systems, both optically and mechanically, is not as simple as it might seem. Followspots must image the gate/aperture at a variety of far-focuses and preferably hold focus without adjustment when focal length is varied—which requires compensating cams, linkages or belts. Followspots must further provide relatively large hyperfocal regions for the color changer and dowser whose performance should not degrade substantially at different focus/focal length combinations. Further, some form of interlock is desirable to prevent the operator from using the iris for diameter reduction before the lens system is at maximum focal length (and hence highest efficiency)—which also requires a mechanical system.

Thus, beam size adjustment of prior art followspots requires three elements (two lenses and an iris) whose operation must be coordinated through the range of beam sizes for best results. Remotely controlling such systems requires either an actuator for each control provided for attended operation—plus the mechanical systems described with their attendent cost and reliability problems—or requires a separate actuator for each of the three elements with coordination provided by the control system.

Refer now to FIGS. 3 and 3A where a novel means for controlling beam size is illustrated, employing a single element of unusual simplicity, reliability and economy.

FIG. 3 shows a fixed focal length lens system with lenses 105 and 107 optimized for efficiency and provided with a focal plane in the region of gate 103 and a hyperfocal region 601 for the color changer and/or dowser, if required. The beam produced by this system is directed at a reflective surface 603 and thence to the subject. The reflective surface may be deformed to produce either a convex or concave surface or both. Many methods of deforming the surface are possible and the precise method employed does not bear on the principles of the invention.

FIG. 3 illustrates one method. The reflective surface 603 has been deposited on a flexible film, such as mylar, which is stretched over the mouth of a cylindrical vessel 605. This cylinder has been connected with a commercially available pneumatic piston 607 driven by an actuator 609 and is otherwise sealed from the outside atmosphere. With the piston/actuator in its center position, as illustrated, air pressure inside and outside the cylinder is equal, the reflective surface 603 is flat, and the beam incident upon it is unaffected. Movement of the piston 607 in the direction of the actuator 609 reduces air pressure in the cylinder 605 relative to the outside atmosphere, which presses the film surface 603 inward, forming it into a concave shape 611 which serves as a converging element, reducing the diameter of the beam reflected from it. Likewise, a motion of the piston in the direction of the cylinder 605 will produce a positive pressure inside the cylinder, forming the reflective film 603 into a divergent optical element (convex shape 613) increasing the size of a beam reflected from its surface.

Many other methods of deforming the reflective surface are possible, including direct mehanical drive. Feedback as to mirror position, and with it beam size, can be provided by many means, FIG. 3 illustrating an inexpensive semiconductor pressure transducer 615.

The benefits of the disclosed device are many. Beam diameter may be varied over a wide range with one moving element. The efficiency of the device is extremely high (being that of the reflective surface, itself) and there is no effect on focus and hence no compensation required, over the range of beam size adjustment. Differences in beam characteristics can, however, be deliberately introduced. Adjustment of the curvature of the reflecting surface through material selection or the design of the actuating means or both can produce changes in edge-to-center intensity distribution. Significant changes in beam shape over the size range may also be deliberately produced. Consider, for example, the addition of an elliptical flange 617 to the mouth of the cylinder 605, the reflective surface 603 stretched over the edges of the flange as shown in FIG. 3A. Under negative pressure, outside air pressure deforms the reflective surface 603 into the mouth of the cylinder 605 which, being circular, does not affect beam shape. However, when the interior of the cylinder 605 is raised to positive pressure relative to the surrounding atmosphere, the shape of the reflective surface 603 is determined by its elliptical mounting, forming shape 619. The result is that a circular beam incident upon the device not only increases in size, but assumes an oval shape more appropriate to illuminating several performers standing side-by-side.

Although the optical system of the present invention as illustrated in FIG. 3 is discussed in the context of a followspot, it is clear that it can be applied with considerable advantage to many types of performance lighting fixture.

For example, lenses 105 and 107 can be replaced with a beam forming mirror as disclosed in U.S. Pat. No. 3,900,726. Given suitable engineering, a single deformable mirror can serve as both beam forming and size control element. Similarly, a deformable mirror could serve as beam size control for fixtures whose light gathering reflector constitutes their beam forming means such as open-faced motion-picture luminaires (e.g., the Type 4081 "Mickey Mole", manufactured by Mole-Richardson, 937 North Sycamore Avenue, Hollywood, Calif. 90038) whose beam size is currently varied by mechanically displacing the bulb relative to the reflector's focal point or vice versa.

The reflective surface may be actuated manually, and the use of a deformable mirror as disclosed does not rule out the addition of an iris 104 to provide additional beam size adjustment range or to allow beam size reduction without an accompanying increase in beam intensity (although reducing light source output by electronic or mechanical means is another method of achieving the same object).

FIG. 3 also illustrates methods of adjusting two other beam parameters; edge cutoff and shape.

Prior art followspots provide a focus adjustment to maintain a hard-edged beam (i.e., image the aperture) at a variety of "throws" or fixture-to-subject distances. However, certain productions may require a soft-edged beam and most prior art followspots can only approximate this effect after being racked out of focus for the throw (often with undesirable effects on edge-to-center intensity distribution and/or the quality of the hyperfocal region and with it, the appearance of color and intensity changes).

The followspot of the present invention provides a method of adjusting edge cutoff without altering the relationship between light source and beam forming elements (and hence beam performance) by displacing the aperture relative to the focal point.

Accordingly, FIG. 3 shows a lead screw 629 driven by an actuator 627 capable of displacing the aperture assembly along the optical axis relative to the focal point. This technique may be used in combination with a conventional focal adjustment of the beam forming elements or as the sole focus adjustment for changes in "throw."

Another novel form of beam modification provided by the remoted followspot of the present invention is the ability to insert gobos in the focal plane.

Gobos (or 'stencils for light') are metal templates used to project abstract or realistic light patterns on stage or scenery; currently by insertion in the gate/aperture of a leko. This approach requires one fixture for each gobo with its accompanying cable, dimmer and control, even though it may be used for only minutes or seconds during the performance. Beyond the direct and indirect costs in hardware, this approach to gobo projection often presents a space problem. Because of the need for a relatively oblique angle to prevent distortion, only a small proportion of available hanging positions are suitable, and as a result, a large number of gobo instruments vie with each other and those required for general stage illumination for the limited number of suitable hanging positions.

If, however, fixtures with remotely variable azimuth and elevation control were equipped with a means to selectively insert any one of a number of gobos in its gate, a single such instrument could replace many conventional fixtures; reducing the amount of cabling, dimming and control required as well as the congestion at suitable hanging positions.

Accordingly, FIG. 3 shows a disc 623 with a number of openings in which gobos (such as distributed by "The Great American Market", Woodland Hills, Calif. 91364) may be mounted. Actuator 621 rotates disc 623, allowing the insertion of the desired gobo in the beam. When the fixture will also be used as a followspot, one such opening will be left open.

As the intention of the disclosed device is to project recognizable patterns (and not simply reduce aperture size) correct focus for the throw is important. Accordingly, aperture displacing actuator 627 is equipped with a feedback transducer 631 (shown here as a multi-turn potentiometer) providing position/focus feedback for the aperture assembly on which gobo carrier 623 is mounted, which may be used in conjunction with display and/or memory components to assure correct focus for the throw.

What is claimed is:

1. In a light projector suitable for performance lighting and capable of beam azimuth and elevation adjustment, the improvement comprising: means for controlling beam azimuth and elevation from a remote location, said means for controlling including an input device sensing the location of the operator's finger, hand, or a stylus or mouse in two dimensions by non-mechanical means.

2. In a light projector generating a beam suitable for performance lighting;

(a) means for adjusting beam azimuth and elevation from a remote location;

(b) a short term memory for storing position information, said adjusting means responsive to said short term memory; and (c) a two-axis input device providing an input to said short term memory.

3. Apparatus according to claim 2, wherein said two-axis input device comprises means for sensing the location of the operator's finger, hand, or a stylus or mouse in two dimensions by non-mechanical means.

4. In a light projector generating a beam suitable for performance lighting and capable of beam azimuth and elevation adjustment, means permitting adjustment from a remote location including:

(a) an input device producing values corresponding to the amount of offset in two axes from a condition representing null; and (b) means for displacing said beam at a rate proportional to said offset values.

5. Apparatus according to claim 4, wherein said input device comprises means for sensing the location of the operator's finger, hand, or a stylus or mouse in two dimensions by non-mechanical means.

6. Apparatus according to claim 1, 2, or 4 and further including means for storing desired azimuth and elevation values, the beam-adjusting means capable of conforming beam azimuth and elevation settings to the stored values.

7. Apparatus according to claim 1, 2, or 4 and further including means for interfacing said system to an external device.

8. Apparatus according to claim 1, 2, or 4, and further including non-mechanical means for adjustment of the relative beam displacement for a given input value change.

9. Apparatus according to claim 1, 2, or 4, and further including non-mechanical means for adjusting the system slewing rate.

10. In a light projector including:

(a) a light source with associated light-collecting means; and (b) a beam forming means, the improvement comprising:

(c) a reflecting surface of adjustable curvature for providing beam size control; and (d) means for adjusting the curvature of said reflecting surface.

11. Apparatus according to claim 10, wherein said reflecting surface provides both beam forming and beam size control.

12. Apparatus according to claim 10, wherein said reflecting surface provides light collection, beam forming, and beam size control.

13. Apparatus according to claim 10, 11, or 12, wherein said reflecting surface also provides beam geometry control.

14. Apparatus according to claim 10, 11, or 12 and further including means for remote control of said means for adjusting the reflecting surface.

15. Apparatus according to claim 14 and further including sensing means producing a value corresponding to the position of said reflecting surface.

16. Apparatus according to claim 10, and further including an aperture to be imaged by said beam forming means, beam modifying components associated with said aperture and means for displacing the aperture and said associated beam modifying components along the optical axis relative to the focal point of a given adjustment of the beam forming means.

17. Apparatus according to claim 16 and further including means for producing a value corresponding to aperture displacement.

18. Apparatus according to claim 10, wherein said reflecting surface is adjustable in curvature so as to become convex, planar or concave.

* * * * *